US010722897B2

(12) United States Patent
Pallmann

(10) Patent No.: US 10,722,897 B2
(45) Date of Patent: Jul. 28, 2020

(54) DEVICE FOR COMMUNICATION OF PROCESS FEED MATERIAL WITH UPSTREAM SIFTING

(71) Applicant: PALLMANN MASCHINENFABRIK GmbH & Co. KG, Zweibruecken (DE)

(72) Inventor: Hartmut Pallmann, Zweibruecken (DE)

(73) Assignee: PALLMANN MASCHINENFABRIK GmbH & Co. KG, Zweibruecken (DE)

( * ) Notice: Subject to any disclaimer, the term of this patent is extended or adjusted under 35 U.S.C. 154(b) by 1293 days.

(21) Appl. No.: 14/843,478

(22) Filed: Sep. 2, 2015

(65) Prior Publication Data

US 2016/0059239 A1 Mar. 3, 2016

(30) Foreign Application Priority Data

Sep. 2, 2014 (DE) ..... 10 2014 112 599

(51) Int. Cl.

| | |
|---|---|
| ***B02C 13/288*** | (2006.01) |
| ***B02C 23/40*** | (2006.01) |
| ***B02C 23/24*** | (2006.01) |
| ***B02C 23/08*** | (2006.01) |
| ***B02C 13/10*** | (2006.01) |
| ***B02C 23/02*** | (2006.01) |
| ***B02C 13/286*** | (2006.01) |
| ***B02C 18/22*** | (2006.01) |

(52) U.S. Cl.

CPC ..... *B02C 13/288* (2013.01); *B02C 13/10* (2013.01); *B02C 13/286* (2013.01); *B02C 18/2225* (2013.01); *B02C 23/02* (2013.01); *B02C 23/08* (2013.01); *B02C 23/24* (2013.01); *B02C 23/40* (2013.01); *B02C 2013/28618* (2013.01)

(58) Field of Classification Search

CPC ..... B02C 13/09; B02C 13/10; B02C 13/286; B02C 13/288; B02C 13/28618; B02C 23/02; B02C 23/08; B02C 23/23; B02C 23/40; B02C 18/2225

USPC ..... 241/57, 73, 79, 186.2, 189.1

See application file for complete search history.

(56) References Cited

U.S. PATENT DOCUMENTS 2,678,169 A * 5/1954 Tullis ..... B02C 13/26 241/56

4,288,038 A 9/1981 Williams (Continued)

FOREIGN PATENT DOCUMENTS

DE 43 16 350 C1 11/1994

*Primary Examiner* — Faye Francis

(74) *Attorney, Agent, or Firm* — Muncy, Geissler, Olds & Lowe, P.C.

(57) ABSTRACT

A device for the comminution of free-flowing feed material is provided that includes a housing enclosing a comminution chamber which contains a rotor that rotates around an axis, and has comminution tools over its circumference. A feeding device to transport the feed material to the comminution chamber in form of a gas-solid matter mixture, wherein the feeding device features a pneumatic sieve passage which uses the effect of gravity for removal of foreign particles from the feed material. In order to operate both the sieve passage and the device under optimal process parameters, the device features at least one inlet port for the supply of secondary air, wherein the at least one inlet port flows into the gas-solid matter mixture downstream of the sieve passage.

16 Claims, 3 Drawing Sheets

(56) References Cited

U.S. PATENT DOCUMENTS

| | | | | |
|---|---|---|---|---|
| 4,428,536 | A * | 1/1984 | Rodgers | B02C 13/13<br>241/154 |
| 4,848,677 | A * | 7/1989 | Rayner | B02C 13/09<br>241/40 |
| 5,004,167 | A * | 4/1991 | McGee | B02C 9/00<br>241/154 |
| 5,529,250 | A | 6/1996 | Pallmann | |
| 6,431,477 | B1 * | 8/2002 | Pallmann | B02C 13/08<br>241/186.3 |
| 9,327,290 | B2 * | 5/2016 | Alekseev | B02C 17/16 |

* cited by examiner

DEVICE FOR COMMUNICATION OF PROCESS FEED MATERIAL WITH UPSTREAM SIFTING

This nonprovisional application claims priority under 35 U.S.C. § 119(a) to German Patent Application No. 10 2014 112 599.1, filed on Sep. 2, 2014, all of which is herein incorporated by reference.

BACKGROUND OF THE INVENTION

1. Field of the Invention

The invention relates to a device for the comminution of free-flowing feed material through which air flows.

2. Description of the Background Art

Such devices are associated with the field of mechanical process engineering and serve to comminute free-flowing substances such as, for example, minerals, pharmaceutical and chemical substances, foodstuffs, materials containing cellulose, synthetics, and the like. Typical for such devices is an air stream produced by a rotor, so-called internal air, which assumes the transportation of the feed material into and out of the comminution device and also ensures the cooling of the feed material and the comminution tools. In addition, subject to its flow speed, the internal air determines the length of stay of the feed material in the comminution section and thus the degree of comminution. The precise adherence to the machine-specific internal air quantity during operation of generic devices is thus highly important for producing a high-quality, final product.

To prevent damage of devices due to foreign particles in the feed material, it is further a known practice to provide a gravity sifter at the material infeed. By a significant change in material flow direction at the comminution device infeed, due to their mass inertia, foreign particles are separated from the material stream, wherein the separation limit is determined by the speed of the material stream. In order to adhere to a predetermined separation limit, it is thus necessary to supply the gravity sifter with a constant loading rate.

A problem which arises here is that as a rule, the internal air quantity of a comminution device is much greater than the internal air quantity of the upstream sifter. Operating a comminution device with an optimal internal air quantity leads to material stream speeds in the sieve passage in which undesirably, also useful feed material is discharged from the material stream.

In order to avoid this, a comminution machine through which gas flows is known from DE 43 16 350 C1, which corresponds to U.S. Pat. No. 5,529,250, and which is incorporated herein by reference, and which contains an upstream infeed apparatus with a sieve passage, wherein in the sieve passage a fan additionally feeds in air.

SUMMARY OF THE INVENTION

It is the objective of the present invention to further improve comminution devices with an upstream, pneumatic sieve passage.

The present invention facilitates the meeting of the conflicting requirements of optimal internal air quantity for the comminution device on the one hand, and optimal internal air quantity for the feeding device on the other without having to take into account economic losses or losses in quality. Thanks to the present invention, the feed material is processed according to optimal conditions in regards to sifting as well as to comminution. During gravity sifting, this allows for a reliable and precise removal of foreign particles from the mixture of gas and solid matter. It also allows for adherence to the optimal processing parameters necessary for the appropriate type of size reduction when comminuting the feed material, for example length of stay of the feed material in the comminution section, temperature of the feed material and the comminution tools, and the like, which ultimately facilitates the economic production of a high-quality, final product.

According to an embodiment of the invention, the inlet port for the supply of secondary air directly feeds into the comminution chamber. This allows on the one hand for a simple and economic construction of inventive devices. At the same time, the opening for the secondary air that is situated well downstream of the sieve passage prevents an undesired influence of the secondary air on the processes taking place in the sieve passage, a condition that would impact the observance of the separation limit.

In an embodiment of the invention, the inlet ports for the supply of secondary air feed into the second channel section of the feeding device with the advantage that the secondary air and the gas-solid matter mixture can mix well and thus create uniform conditions for the comminution process. Preferably, the secondary air is distributed evenly with the help of an annular channel across the circumference of the infeed channel ending in the comminution device so that the entire circumference of the infeed channel can be uniformly supplied. The secondary air coming from the annular channel can hereby feed directly into the comminution chamber of the comminution device, or indirectly via openings into the infeed channel which then leads to the comminution chamber.

In order to on the one hand adapt to the feed material and the type of size reduction, but on the other hand also achieve optimal processing during the active comminution operation, a further, advantageous embodiment of the invention can regulate the secondary air quantity. For this, a regulating body is supplied, for example, directly at the inlet port or at the annular channel.

Further openings can be provided for air intake in the rear panel of the comminution device. The secondary air can be supplemented via these openings so that the amount of secondary air that is to enter the area of the feeding device can be smaller. At the same time, additional air in the rear panel region allows for a more uniform cooling of the comminution device.

The invention shows that very good results can be achieved when the secondary air quantity is 10% to 50% of the internal air quantity, though preferably 15% to 35%, most preferably 25%.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 2:
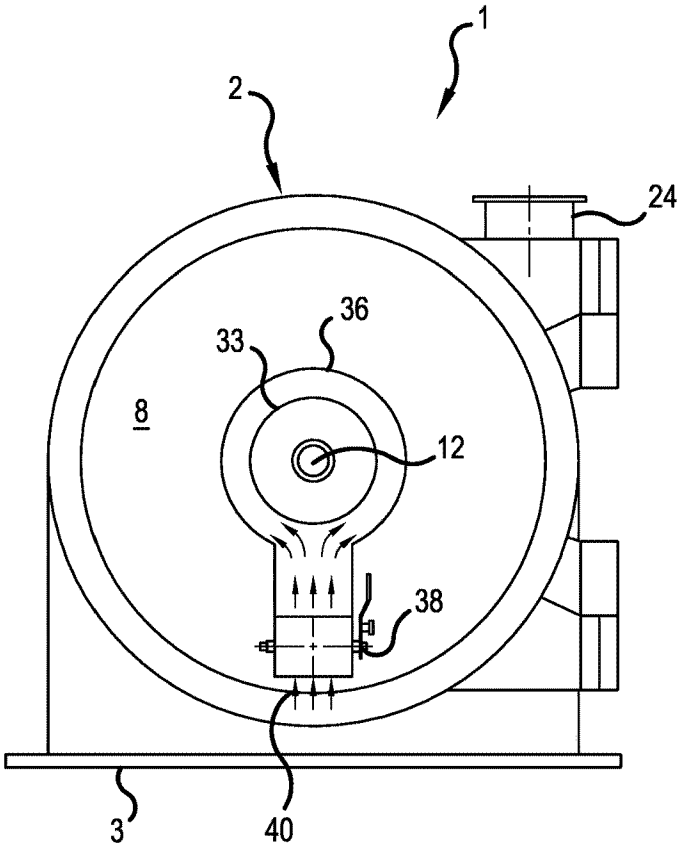
FIG. 2 is a cross section through the device shown in FIG. 1 along the line 11-11 shown there.
Figure 1:
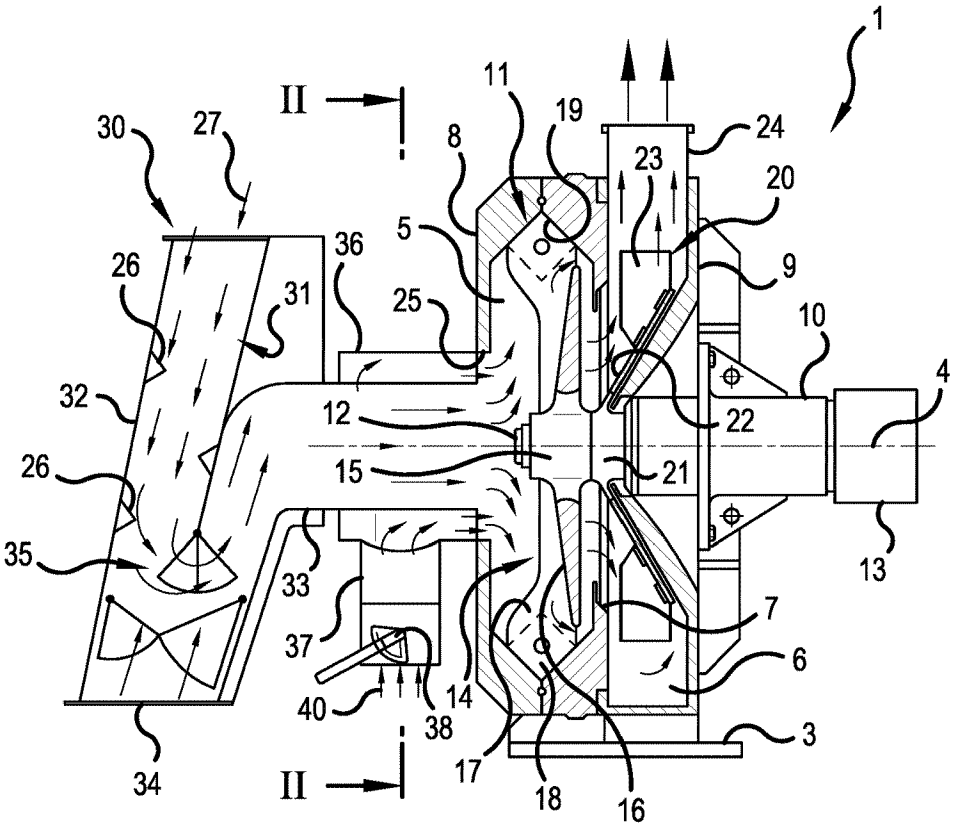
FIG. 1 is a vertical section through a first embodiment of a device according to the invention.

FIGS. 1 and 2 show a comminution device 1 according to the invention in the form of a turbo mill. The comminution device 1 has in essence a cylindrical housing 2 which is tightly connected with the base via a stand 3. The housing 2 encloses a first chamber 5 in which the comminution takes place, and a second chamber 6 that serves to produce air flow and discharge feed material. The two chambers 5 and 6 are consecutively arranged with respect to the housing axis 4 and connected with each other via an opening 7 that is concentric to the axis 4. At the front side, the housing 2 is closed by a front panel 8 and back panel 9. The back panel 9 has a concentric opening in the region of the axis 4 in which a horizontal shaft bearing 10 is situated for the rotatable inclusion of a rotor 11. The rotor 11 is comprised of a shaft 12 that is coaxial to the axis and which end situated outside the housing 2 carries a pulley with numerous grooves 13 for power coupling with a driving mechanism. The end of the shaft 12 resting in the housing 2 extends through both chambers 5 and 6, wherein the shaft section situated in the first chamber 5 carries an impeller 14. The impeller 14 is mainly composed of a hub 15 to which a baffle disk 16 and radial bars 17 connect radially outwards. Comminution tools in the form of impeller wear plates 18 are attached to the ends of the bars 17 which form the rotor circumference. The active edges of all wear plates 18 are situated on a common circle track which is opposed by a baffle rail 19 formed by the inner circumference of the first chamber 5, subject to a radial working gap.

The rotor 11 further encloses a fan wheel 20 which is also attached torque-proof by a hub 21 on the shaft 12 and extends diagonally outward with a cone-shaped plate 22 into the second chamber 6. In the outer circumferential area of the cone plate 22, air blades 23 that are directed radially outwards are arranged at uniform circumference intervals which generate the internal air of the comminution device 1 during operation of the rotor 11. The removal of sufficiently comminuted material takes place via a product discharge 24 which tangentially flows out from the second chamber 6.

To supply the comminution device 1 with feed material, the front panel 8 features a central opening 25 situated axially opposite the shaft 12, to which a feeding device 30 with an integrated gravity sifter attaches. The feeding device 30 has an infeed channel 31 with a first channel section 32 formed as a falling chute and a second channel section 33 attaching thereto at an angle, which flows into the first chamber 5 of the comminution device 1. In the region of the first channel section 32, flow conducting bodies 26 are arranged at the inner surface which help determine the flow direction. The infeed channel 31 undergoes a change in direction of approximately 180° in the region of transition from the first channel section 32 to the second channel section 33, which is linked to a reversal in direction of the material stream. In the outer circumference of the area of redirection, the infeed channel 31 has an opening 34. This area thus forms a sieve passage 35 in which due to their weight and the associated mass inertia, heavier particles in the feed material do not follow the direction of the other material stream. Instead, due to active gravities they are discharged from the feed material through the opening 34.

The longitudinal portion of the second channel section 33 situated directly in front of the feed opening 25 is encircled by an annular channel 36 which is fed with secondary air 40 via a pipe socket 37 radially merging into it. To control the quantity of air, the flow area of the pipe socket 37 can be adjusted via a damper 38. The side of the annular channel 36 facing the comminution device 1 is open so that secondary air in the annular channel 36 uniformly spreading over the circumference of the second channel section 33 enters axially into the first chamber 5 of the comminution device 1 and mixes there with the gas-solid matter mixture from the infeed channel 31.

During operation of a device 1 according to the invention, the gas-solid matter mixture 27 is fed via the first channel section 32 of the sieve passage 35 with an optimum speed and optimum mixing ratio for gravity sifting. Foreign particles in the feed material are discharged through the opening 34 in the area of the sieve passage 35 by the redirection of the material stream. The feed material ultimately reaches the first chamber 5 of the comminution device 1 via the second channel section 33 of the infeed channel 31.

The internal air necessary for optimum comminution of the feed material is drawn in by the fan wheel 20 of the comminution device 1, wherein the amount of air necessary is much greater than what is provided by the gas-solid matter mixture 27. In order to nevertheless supply the comminution device 1 with enough air without diminishing the efficiency of the gravity sifter, the air volume difference is introduced as secondary air 40 into the first chamber 5 of the comminution device 1 via the pipe socket 37 and the annular channel 36. In this way, it is possible to operate both the gravity sifter in the area of the feeding device 30 and the comminution device 1 in adherence to optimal process parameters.

Figure 3:
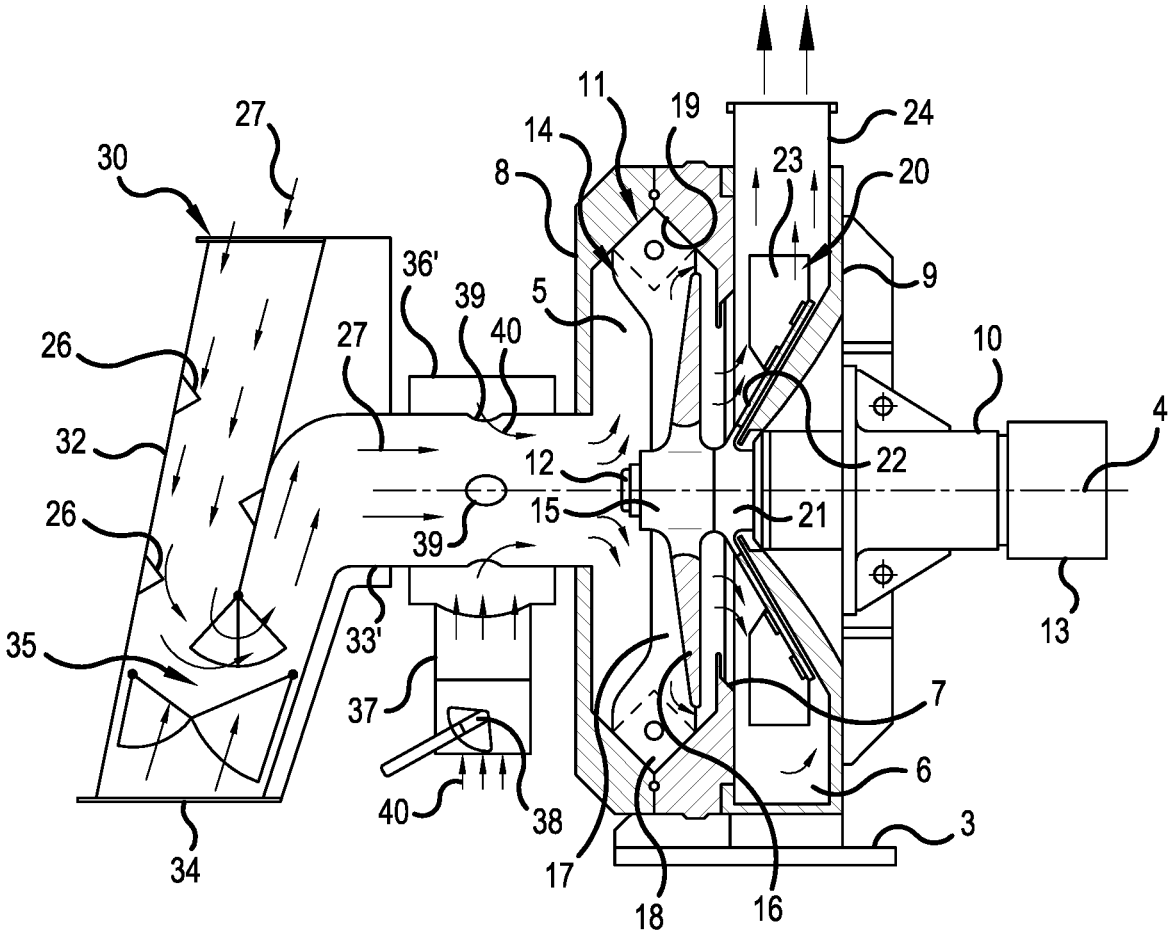
FIG. 3 is a vertical section through a second embodiment of a device according to the invention.

The comminution device 1 illustrated in FIG. 3 for a large part relates to the one described in FIGS. 1 and 2 so in order to avoid repetition, reference is made to those using the same reference signs. In contrast to the embodiment described above, the secondary air 40 in the comminution device 1 in FIG. 3 is not directly fed from the annular channel 36' into the comminution device 1, but instead indirectly via the second channel section 33' of the feeding device 30. For this purpose, the annular channel 36' is closed on all sides, wherein the second channel section 33' features several openings 39 in uniform circumference intervals in the region encircled by the annular channel 36', for example 2, 3 or 4 openings 39. The secondary air 40 thereby flows radially from the annular channel 36' through the openings 39 in the second channel section 33' of the infeed channel 31 and there already interfuses with the gas-solid matter mixture 27.

Figure 4:
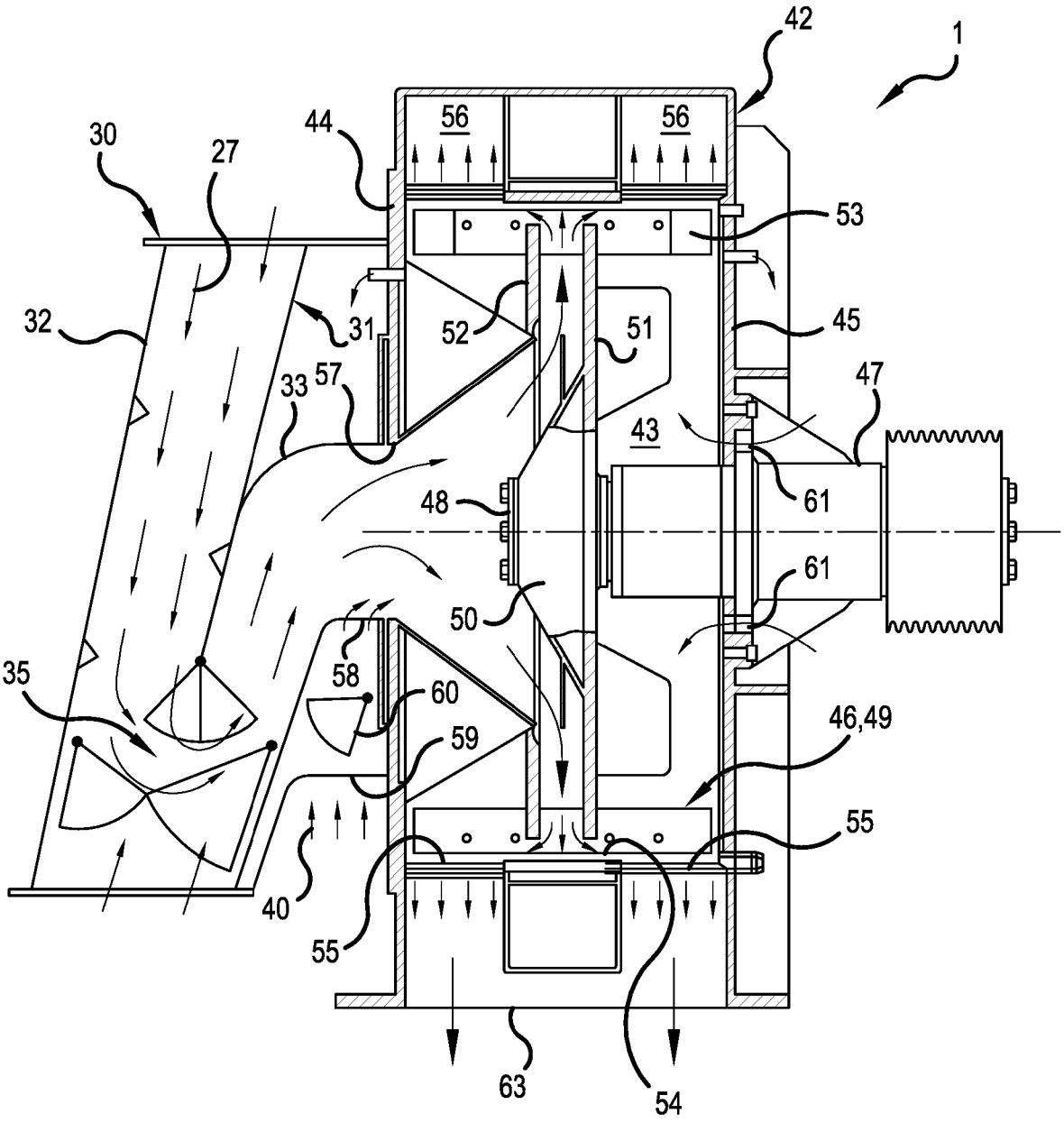
FIG. 4 is a vertical section through a third embodiment of a device according to the invention.

FIG. 4 shows an embodiment of the invention in which the comminution device 1 is exemplified by a whirlwind mill. The whirlwind mill has a cylindrical housing 42 which encloses a comminution chamber 43. At the circumference, the housing 42 is surrounded by a housing cover 44 which is open towards the bottom for the formation of a product discharge 63. The housing 42 serves to hold a rotor 46 which is rotatable inside a shaft bearing 47, centrally inserted in the back panel 45. The shaft 48 of the rotor 46 thereby carries a multi-groove plate with its end situated outside the housing 42 via which the rotor 46 is powered. At the end opposite the shaft 48, there are an impeller 49 formed by a hub cone 50 coaxially situated on the shaft 48, a support disk 51 and a washer 52 piano-parallel thereto, which all receive axially aligned impeller wear plates 53 at their outer circumference.

A central baffle rail 54, connected in axial direction on each side to a sieve rail 55, sits opposite the impeller wear plates 53 spaced by a comminution gap. The sieve rails 55 are hereby set off in radial direction from the housing cover 44, thereby forming an annular channel 56 via which the sufficiently fined material is removed and fed to the product discharge 63.

In the front panel 44, an opening 57 concentric to the rotational axis is arranged which is connected to the feeding device 30. The feeding device 30 largely corresponds to the ones described in FIGS. 1 to 3 so that for the same characteristics, the aforesaid is valid. The feeding device 30 thus includes an infeed channel 31 with a first channel section 32 and a second channel section 33 which are separated from one another by a sieve passage 35. The second channel section 33 thereby attaches to the opening 57 in the front panel 44 of the invented device 1.

For the infeed of secondary air 40, an opening 58 is provided directly in front of opening 57 in the second channel section 33 of the infeed channel 31. Outside of the second channel section 33, the opening 58 is surrounded by an air duct 59 which is formed by the front panel 44 and the second channel section of the feeding device 30 situated opposite thereto, as well as two piano-parallel side plates 59 which connect the front panel 44 with the feeding device 30 and are at a distance to each other. A swivel-mounted damper 60 with which the amount of secondary air 40 can be regulated is embedded in the air duct 59.

During operation at the impeller 49, the whirlwind mill generates an air stream (internal air) with the impeller wear plates 53 and the air blades 23 which constitutes the propulsion for the material stream through the mill. The whirlwind mill thereby draws in the feed material 27 through the feeding device 30, where in the sieve passage 35 area, unsuitable feed material is removed. The sifted feed material then travels through the opening 57 via a disk-shaped channel between the support disk 51 and the washer 52 to the impeller wear plates 53 and the baffle rail 54. From there, after sufficient comminution, it reaches the lateral sieve rails 55 and from there is channeled out of the whirlwind mill via the annular channels 56 and the product discharge 63.

Since the intrinsic internal air amount of the whirlwind mill is significantly greater than what is necessary for the area surrounding the gravity sifter, secondary air 40 is fed into the whirlwind mill via the air duct 59 and the opening 58. Additionally, air can be fed into the comminution chamber 5 through the openings 61 at the back panel 45 of the whirlwind mill in order to supply the whirlwind mill with sufficient internal air.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A device for comminuting free-flowing feed material, the device comprising:

a housing;

a comminution chamber being substantially enclosed by the housing, the comminution chamber having a rotor that rotates around an axis and having comminution tools arranged about a circumference of the rotor;

a feeding device positioned upstream of the comminution chamber and rotor and that transports the feed material to a central opening of the comminution chamber, the feeding device having a pneumatic sieve passage that uses gravity for removal of foreign particles from the feed material before the feed material is comminuted by the rotor in the comminution chamber;

at least one inlet port for a supply of secondary air, the at least one inlet port ending in the gas-solid matter mixture downstream of the sieve passage; and an annular channel that feeds the supply of secondary air to the at least one inlet port, wherein the feeding device has an infeed channel with a first channel section arranged upstream of the pneumatic sieve passage and a second channel section arranged downstream of the pneumatic sieve passage that feeds into the comminution chamber, and wherein the annular channel, that feeds the supply of the secondary air to the at least one inlet port, encloses the second channel section of the feeding device, such that the annular channel surrounds and encircles an exterior surface of the second channel section.

2. The device according to claim 1, wherein the at least one inlet port ends directly in the comminution chamber.

3. The device according to claim 1, wherein the at least one inlet port ends in the second channel section.

4. The device according to claim 1, wherein the second channel section of the infeed channel features at least one opening in an area of the annular channel.

5. The device according to claim 4, wherein the annular channel is open at a side facing the housing and connects to the central opening of the comminution chamber.

6. The device according to claim 1, further comprising a regulating body to control an amount of the secondary air.

7. The device according to claim 6, wherein the regulating body is arranged at an annular channel.

8. The device according to claim 6, wherein the amount of the secondary air is 10% to 50% of an internal air amount.

9. The device according to claim 6, wherein the amount of the secondary air is 15% to 35% of the internal air amount.

10. The device according to claim 6, wherein the amount of the secondary air is 25%.

11. The device according to claim 1, further comprising at least one opening for the intake of air in an area of a back panel.

12. The device according to claim 1, wherein an air flow and feed material discharge chamber is provided downstream of the comminution chamber, the air flow and feed material discharge chamber having a fan wheel therein, the fan wheel being mounted on a same shaft as the rotor of the comminution chamber.

13. The device according to claim 1, wherein the annular channel encloses the second channel section of the feeding device, such that the annular channel that feeds the supply of secondary air to the at least one inlet portion is coaxial with the second channel section.

14. The device according to claim 1, wherein the second channel section that is arranged downstream of the pneumatic sieve passage includes a vertically-oriented portion and a horizontally-oriented portion, the annular channel enclosing the horizontally-oriented portion of the second channel section.

15. The device according to claim 14, wherein a flow direction of the feed material through the first channel section is opposite to a flow direction of the feed material through the vertically-oriented portion of the second channel section.

16. The device according to claim 1, wherein the pneumatic sieve passage is provided at a transition between the first channel section and the second channel section, and wherein a flow direction of the feed material is reversed at the transition between the first channel section and the second channel section.

* * * * *